US006056065A

United States Patent [19]

Campbell et al.

[11] Patent Number: 6,056,065

[45] **Date of Patent: *May 2, 2000**

[54] MOTORIZED AUGER

[75] Inventors: Jeffery D. Campbell, Fresno; Rick Dean Fox, Santa Cruz, both of Calif.

[73] Assignee: Power Technology Unlimited, Inc., Fresno, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 09/133,391

[22] Filed: Aug. 13, 1998

[51] Int. Cl.[7] ..... A01B 33/00

[52] U.S. Cl. ..... 172/42; 172/254; 175/170; 173/185

[58] Field of Search ..... 172/42, 43, 44, 172/49.5, 41, 245, 246, 247, 254, 21, 22; 173/135, 46; 175/170; 180/19.1, 19.3; 37/403

[56] References Cited

U.S. PATENT DOCUMENTS

| | | | |
|---|---|---|---|
| 3,835,941 | 9/1974 | King | 175/88 |
| 3,976,147 | 8/1976 | Cunningham | 173/22 |
| 4,077,480 | 3/1978 | Carlson et al. | 173/22 |
| 4,155,527 | 5/1979 | Sjoberg | 173/22 X |
| 4,961,471 | 10/1990 | Ovens | 175/170 |
| 4,979,578 | 12/1990 | Landry | 175/162 |
| 5,363,925 | 11/1994 | Gallagher | 173/186 |
| 5,388,654 | 2/1995 | Heiss | 175/170 |
| 5,396,967 | 3/1995 | Stewart | 175/170 |
| 5,673,773 | 10/1997 | Lai | 188/24.17 |
| 5,836,402 | 11/1998 | Jones | 173/185 |

*Primary Examiner*—Victor Batson
*Attorney, Agent, or Firm*—Jeffrey A. Hall

[57] ABSTRACT

A motorized auger comprising a frame with a pair of handles secured to the frame. Each handle having a proximal and a distal end thereto and a pair of downwardly depending support elements. A first wheel is secured to the distal ends of the pair of handles by frame elements and a rear set of wheels is secured to the proximal ends of the pair of handles by frame elements. A drive mechanism includes a chain and a sprocket operably linked to a drive engine and to a wheel, the wheel having an internal brake drum and internal brake shoes. The internal brake drum and internal brake shoes are linked to a brake cable having a cam for tension reduction secured thereto. A throttle mechanism is engaged to the drive engine and an auger is mounted to the frame. The auger is linked to a hydraulic drive motor and the auger and the hydraulic drive motor are secured to an auger mounting track element.

10 Claims, 2 Drawing Sheets

MOTORIZED AUGER

BACKGROUND OF THE INVENTION

1. Field of Invention

This invention relates augers, and more particularly to augers which are equipped with wheels, an engine, and drive means for propelling the apparatus.

2. Description of the Related Art

The usefulness of augers are well known to those involved in construction, gardening, and other building activities where a hole or series of holes are dug in the ground. Prior augers have been proposed and developed which are hand transported or placed on various apparatuses such as truck beds for movement from one location to another.

Such augers are useful for particular applications, however, all suffer from significant disadvantages and limitations when used for small mixing jobs, construction, home repair, garden work and the like. For example, such augers are heavy, difficult to hold and operate, bulky, cumbersome, and difficult and dangerous to use in many types situations such as fence construction, foundation work, construction, landscaping and the like.

Accordingly, it is the primary object of this invention to provide a motorized auger with a hydraulic driven drive motor which is lightweight, strong, balanced, and efficient at boring or digging in a wide variety of different substances such as dirt, gravel, sand and other particulates. The motorized auger of the present invention has high performance capability and possesses sufficient power to drive the auger at both slow speeds or at high speeds over varied terrain and to power the auger to dig in various soil types. The auger of the present invention is equipped with a front wheel and a rear set of wheels for balance and ease of movement.

Additional objects and advantages of the invention will be set forth in the description which follows, and in part will be obvious from the description, or may be learned by practice of the invention. The objects and advantages of the invention may be realized and obtained by means of the instrumentality's and combinations particularly pointed out in the appended claims.

SUMMARY OF THE INVENTION

To achieve the foregoing objects, and in accordance with the purpose of the invention as embodied and broadly described herein, a motorized auger is provided comprising a frame with a pair of handles secured to the frame. Each handle having a proximal and a distal end thereto and a pair of downwardly depending support elements. A first wheel is secured to the distal ends of the pair of handles by frame elements and a rear set of wheels is secured to the proximal ends of the pair of handles by frame elements. A drive mechanism includes a chain and a sprocket operably linked to a drive engine and to a wheel, the wheel having an internal brake drum and internal brake shoes. The internal brake drum and internal brake shoes are linked to a brake cable having a cam for tension reduction secured thereto. A throttle mechanism is engaged to the drive engine and an auger is mounted to the frame. The auger is linked to a hydraulic drive motor and the auger and the hydraulic drive motor are secured to an auger mounting track element.

The motorized of the present invention is lightweight, balanced, efficient, and highly effective at allowing a user to dig or bore holes in all soil types with great efficiency and control. The auger of the present invention allows a user to dig or bore holes easily and efficiently thereby providing both a highly efficient and portable hole digging or drilling means.

BRIEF DESCRIPTION OF THE DRAWINGS

The accompanying drawings, which are incorporated in and constitute a part of the specification, illustrate a preferred embodiment of the invention and, together with a general description given above and the detailed description of the preferred embodiment given below, serve to explain the principles of the invention.

DESCRIPTION OF THE PREFERRED EMBODIMENTS

Reference will now be made in detail to the present preferred embodiments of the invention as illustrated in the accompanying drawings.

In accordance with the present invention, there is provided in a preferred embodiment of the invention, a motorized auger comprising a frame with upwardly and downwardly depending frame elements with a pair of handles secured to the frame. Each handle having a proximal and a distal end thereto and a pair of downwardly depending support elements. A first wheel is secured to the distal ends of the pair of handles by frame elements and a rear set of wheels is secured to the proximal ends of the pair of handles by frame elements. A drive mechanism includes a chain and a sprocket operably linked to a drive engine and to a wheel, the wheel having an internal brake drum and internal brake shoes. The internal brake drum and internal brake shoes are linked to a brake cable having a cam for tension reduction secured thereto. A throttle mechanism is engaged to the drive engine and an auger is mounted to the frame. The auger is linked to a hydraulic drive motor and the auger and the hydraulic drive motor are secured to an auger mounting track element.

Figure 1:
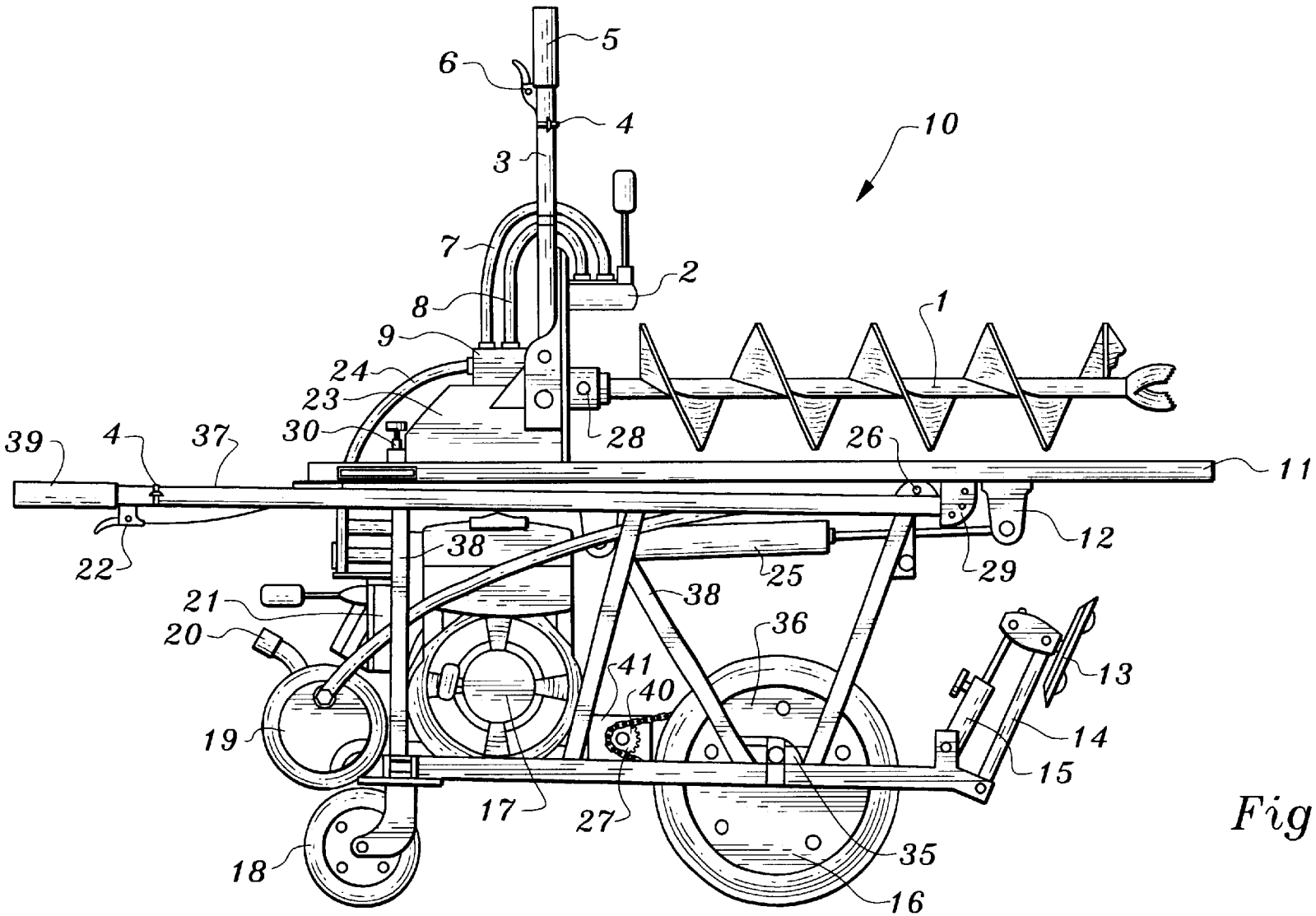
FIG. 1 is a left side elevational view of a motorized auger, according to the invention.

In FIG. 1, the motorized auger 10, is shown according to a preferred embodiment of the invention with upwardly and downwardly depending frame elements 37 mounted on frame 38. Upright frame elements 37 downwardly depend and may be used for additional support and stability. The frame is secured to a pair of handles 39 each having a proximal and a distal end thereto and which are preferably provided with handle grips.

Figure 2:
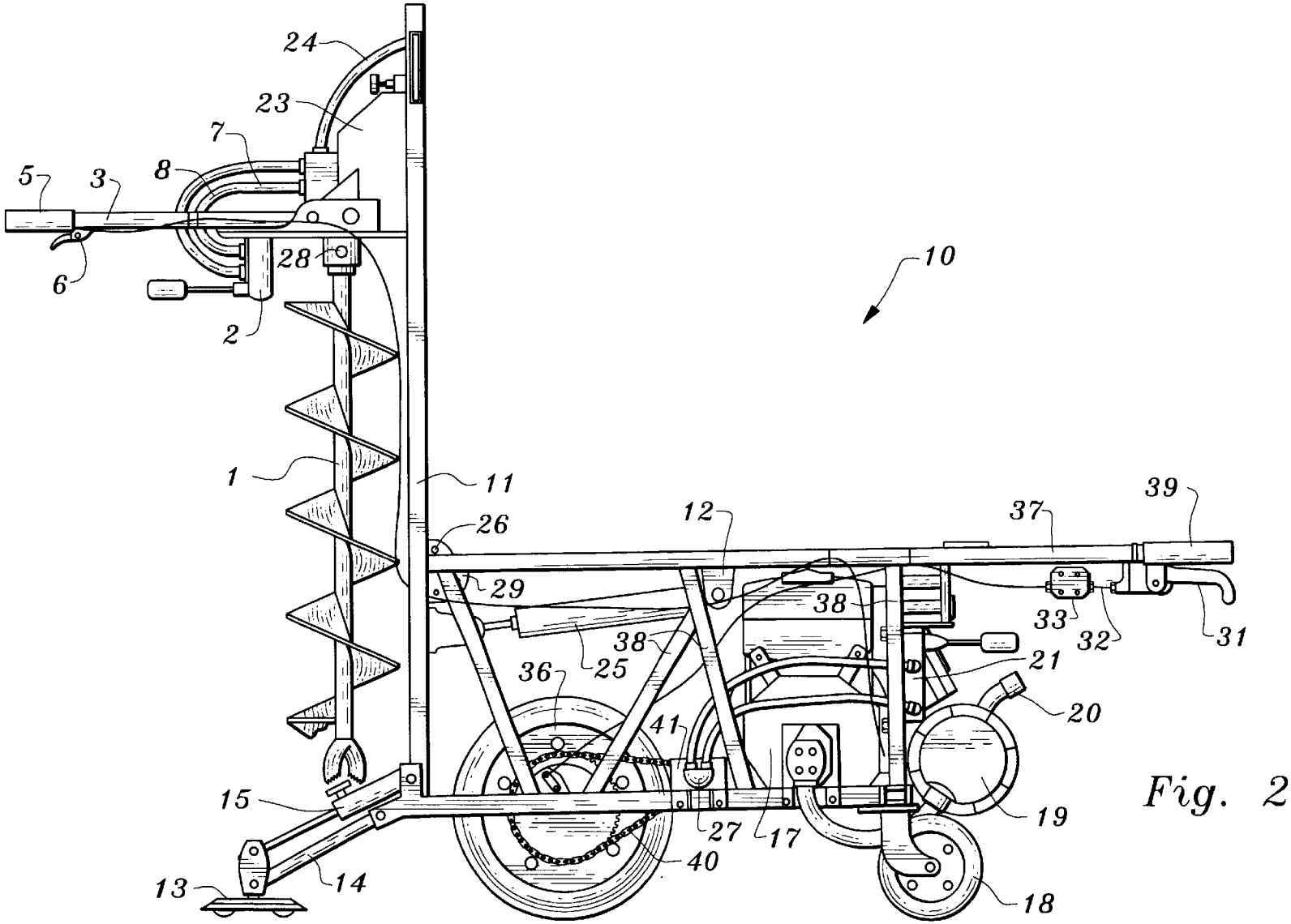
FIG. 2 is a right side elevational view of such auger, according to the invention.

As seen in FIGS. 1 and 2, auger 1, which is preferably composed of steel or other durable and resilient material is secured to frame 37. Auger 1 is secured to a steel collar with locking pin 28 and to handle 3 with handle grip 5. Auger trigger throttle 6 and safety kill switch 4, are operably linked to hydraulic drive motor 9 which has forward hydraulic hose 7 and reverse hydraulic hose 8 operably secured at one end thereto. Hydraulic hose 7 and 8 are operably secured at another end to lever valve 2 which is mounted to auger mounting track 23. A hydraulic supply hose 24 feeds into hydraulic drive motor 9.

In FIGS. 1, 2, a first wheel 16 is secured to the distal ends of handles 39 by frame 38 and upright elements 37. Wheel 16 preferably has a 16 inch by 4 inch three ply tire, however, other sizes may be substituted as desired. Wheel 16 may be provided with extension bearing hubs if desired. Wheel 16 is operably linked by an axle to sprocket 27 linked to drive engine 17. Sprocket 27 is preferably a toothed sprocket, but may be otherwise. Wheel 16 has an internal brake drum 35 and internal brake shoes 36 operably linked to a brake cable 32 with cam 33 for controlled tension reduction, and to brake lever 31.

Best seen in FIG. 1, a drive mechanism, preferably comprising drive chain 40 is operably linked to hydraulic drive motor 41 and sprocket 27. Drive engine 17, which is preferably a 10.5 horsepower gas motor with recoil start means, and is preferably mounted on frame 37 with bolts, screws or other mechanical fastening means. Hydraulic oil tank 19 is mounted to frame 37 and has spout 20. A hydraulic valve 21, which is preferably a four-way hydraulic splitter valve, is secured to frame element 38.

A channel track element 11, preferably composed of steel or other durable resilient material, has track mount 12 and locking spring loaded pin and track 29 secured thereto. A shaft 26 with pivot bracket is preferably secured to channel track 11. A track locking pin 30 is secured to the other end of channel track 11, and is preferably positioned above frame element 38. A "stiffleg" pad 13 is mounted to control arm 14 which is mounted to "stiffleg" control slide element 15.

In FIGS. 1 and 2, a pair of rear wheels 18 are shown mounted to frame. Preferably rear wheels 18 are 6" pneumatic carriage type wheels, but may be otherwise. Rear wheels 18 are preferably detachably mounted to frame 37 by bolt or screw mount, or a quick release type mechanism. A trigger throttle 22 is seen secured to frame 37 for control of the speed of operation of engine 17. A shock absorber 25, preferably an air dampening shock absorber is mounted to frame element 38 and to track mount 12.

In operation and use, motorized auger 10 is very efficient and easy to use for digging or boring holes in any soil type. For example, a user may begin operation of motorized auger 10 by turning on kill switch 4 to the "on" position. The user then starts engine 17 and depresses brake lever 31. The hydraulic valve 21 is then lifted to forward drive or pushed down for reverse drive to engage hydraulic drive motor 41. When the user has reached the position chosen he or she releases trigger throttle 22 and brake lever 31. The user then lowers "stiffleg" adjustable knob 15 to the ground position and tightens adjustable knob 15 to the lock position. The user then lifts auger 1 and auger track 11 to an approximate 90 degree angle and sets locking spring loaded pin and track 29 to lock the auger in position. The user then grasps the auger handles 3 and reaches auger lever valve 2 up to engage hydraulic auger motor 9 for drilling. The auger track locking pin 30 is then pulled to release the auger to ground level. Trigger throttle 6 is then depressed until a desired digging or boring speed is reached. When the digging or boring is complete the user then lifts auger 1 up by handles 3 until track locking pin 30 engages.

Additional advantages and modification will readily occur to those skilled in the art. The invention in its broader aspects is, therefore, not limited to the specific details, representative apparatus and illustrative examples shown and described. Accordingly, departures from such details may be made without departing from the spirit or scope of the applicant's general inventive concept.

What is claimed is:

1. A motorized auger, comprising:

a frame;

a pair of handles secured to said frame each handle having a proximal and a distal end thereto and a pair of downwardly depending support elements;

a channel track element, said channel track element having a track mount and a track secured thereto; said channel track element being secured to the frame;

a first wheel secured to the distal ends of the pair of handles by frame elements, said first wheel being operably linked to a sprocket by an axle;

a rear set of wheels secured to the proximal ends of the pair of handles by downwardly depending frame elements;

a drive mechanism including a chain and a sprocket operably linked to a drive engine and to a wheel, said wheel having an internal brake drum and internal brake shoes; said internal brake drum and internal brake shoes being linked to a brake cable having a cam for tension reduction secured thereto;

a throttle mechanism being operably engaged to said drive engine; and an auger being linked to a hydraulic drive motor with a forward hydraulic hose secured at one end to a lever valve, said auger and said hydraulic drive motor being secured to an auger mounting track element; said auger mounting track element being secured to said channel track element by a collar and locking assembly.

2. The motorized auger of claim 1, wherein said drive engine is a gasoline powered engine.

3. The motorized auger of claim 1, wherein said internal brake drum is operably linked to a brake lever mounted on one of said pair of handles.

4. The motorized auger of claim 1, wherein a lever valve is mounted on said auger mounting track element.

5. The motorized auger of claim 1, wherein said rear set of wheels are detachably mounted to said frame.

6. The motorized auger of claim 1, wherein said auger is secured to a handle with a handle grip.

7. The motorized auger of claim 1, wherein said hydraulic drive motor is operably linked to a forwarding hydraulic hose and to a reversing hydraulic hose.

8. The motorized auger of claim 1, wherein said frame further includes a control arm.

9. The motorized auger of claim 8, wherein said control arm includes a support pad mounted thereon.

10. The motorized auger of claim 1, wherein said handle has a hydraulic splitter valve operably secured thereto.

* * * * *